US005443579A

United States Patent [19]

Tanaka et al.

[11] Patent Number: 5,443,579

[45] Date of Patent: Aug. 22, 1995

[54] PRINTED MATTER AND METHOD FOR PRINTING THE SAME

[75] Inventors: Toshinori Tanaka, Tokyo; Mitsuo Inoue, Kawasaki, both of Japan

[73] Assignee: Director-General, Printing Bureau, Minstry Finance, Tokyo, Japan

[21] Appl. No.: 70,243

[22] Filed: Jun. 2, 1993

[30] Foreign Application Priority Data

Jun. 4, 1992 [JP] Japan ..... 4-168253

[51] Int. Cl.[6] ..... B42D 15/00

[52] U.S. Cl. ..... 283/93

[58] Field of Search ..... 283/91, 92, 114, 901, 283/93, 904, 117

[56] References Cited

U.S. PATENT DOCUMENTS

| | | | |
|---|---|---|---|
| 4,184,700 | 1/1980 | Greenaway | 283/901 X |
| 4,501,439 | 2/1985 | Antes | 283/91 |
| 4,504,083 | 3/1985 | Devrient et al. | 283/114 X |
| 4,932,685 | 6/1990 | Mancuso | 283/91 |
| 4,988,126 | 1/1991 | Heckenkamp et al. | 283/91 X |
| 5,074,597 | 12/1991 | Mancuso et al. | 283/91 |

FOREIGN PATENT DOCUMENTS

| | | |
|---|---|---|
| 53-98829 | 8/1978 | Japan . |
| 55-117689 | 9/1980 | Japan . |
| 55-45400 | 11/1980 | Japan . |
| 3-67878 | 10/1991 | Japan . |

*Primary Examiner*—Willmon Fridie
*Attorney, Agent, or Firm*—Larson and Taylor

[57] ABSTRACT

By combining raised image lines having a color the same or similar to that of a substrate to be printed, and lines having a color different from that of the raised image lines, there is provided a latent image printed matter which can be prevented from being counterfeited and falsified and with which false and true can be easily distinguished. By printing lines having a different color from that of the raised image lines, there can be provided a printed matter in which letters, figures, etc. can be visually recognized only when viewed in a particular direction.

24 Claims, 3 Drawing Sheets

PRINTED MATTER AND METHOD FOR PRINTING THE SAME

BACKGROUND OF THE INVENTION

This invention relates to a printed matter which is required to have some protection so as not to be counterfeited or falsified, such as bill (paper money), bank note, security paper, passport, credit card, or other valuable printed matter. The invention also relates to a method for printing the printed matter.

Bills (paper money), bank notes, security papers, passports, credit cards, and other valuable printed items are required, because of their nature, to be designed such that they are not easily counterfeited or falsified. There are three known measures for preventing the counterfeiting of such printed matters; the first has a plurality of small and large half tone dots applied thereto at the printing time, the second has a moiré pattern, and the third is provided with a latent image (hidden letters and figures) applied thereto by properly determining the drawing direction of image lines and the quantity of ink to be applied. However, since printed matters provided with the above counter-measures against counterfeiting can be counterfeited by an ordinary photometrical process, they are not very effective for preventing counterfeiting. In addition, it is now possible to make photocopies of bills, bank notes, security papers, etc. in such a manner as to resemble the real ones by using a black and white copying machine or a color copying machine.

SUMMARY OF THE INVENTION

This invention relates to a printed matter which is required to have some protection so as not to be counterfeited or falsified, such as bill (paper money), bank note, security paper, passport, credit card, or other valuable printed matter. The invention also relates to a method for printing the above printed matter.

According to the present invention, there is provided a latent image printed matter comprising: a first printed pattern printed by raised printing on a substrate, said raised printed pattern having a first portion which comprises a plurality of straight parallel spaced apart lines and having a second portion which comprises a plurality of spaced apart wavy lines, or a plurality of straight parallel spaced apart lines slanted with respect to the straight lines of said first portion, or both, said raised printed pattern having a color substantially the same as the color of said substrate; and a second printed pattern printed over said first printed pattern, said second printed pattern having a color substantially different from the color of said substrate and being made up of a plurality of spaced apart straight parallel lines, or a plurality of spaced apart straight parallel lines of dots, or both, said lines of said second printed pattern being either parallel to or slanted with respect to the straight spaced apart parallel lines of said first portion of said first printed pattern.

In another aspect of the present invention, there is provided a method for printing a latent image printed matter comprising: printing by raised printing, a first printed pattern on a substrate, said raised printed pattern having a first portion which comprises a plurality of straight parallel spaced apart lines and having a second portion which comprises a plurality of spaced apart wavy lines, or a plurality of straight parallel spaced apart lines slanted with respect to the straight lines of said first portion, or both, said raised printed pattern having a color substantially the same as the color of said substrate; and printing a second printed pattern over said first printed pattern, said second printed pattern having a color substantially different from the color of said substrate and being made up of a plurality of spaced apart straight parallel lines, or a plurality of spaced apart straight parallel lines of dots, or both, said lines of said second printed pattern being either parallel to or slanted with respect to the straight spaced apart parallel lines of said first portion of said first printed pattern.

From a still further aspect of the present invention, there is provided a latent image printed matter comprising: a first printed pattern printed by raised printing on a substrate, said raised printed pattern having a first portion which comprises a plurality of wavy spaced apart parallel lines and having a second portion which comprises a plurality of spaced apart straight parallel lines, or a plurality of spaced apart wavy parallel lines slanted with respect to the wavy lines of said first portion, or both, said raised printed pattern having a color substantially the same as the color of said substrate; and a second printed pattern printed over said first printed pattern, said second printed pattern having a color substantially different from the color of said substrate and being made up of a plurality of spaced apart wavy parallel lines, or a plurality of spaced apart wavy parallel lines of dots, or both, said lines of said second printed pattern being either parallel to or slanted with respect to the wavy spaced apart lines of said first portion of said first printed pattern.

From an additional aspect of the present invention, there is provided a method for printing a latent image printed matter comprising: printing, by raised printing, a first printed pattern on a substrate, said raised printed pattern having a first portion which comprises a plurality of spaced apart wavy parallel lines and having a second portion which comprises a plurality of spaced apart straight parallel lines, or a plurality of wavy spaced apart parallel lines slanted with respect to the wavy lines of said first portion, or both, said raised printed pattern having a color substantially the same as the color of said substrate; and printing a second printed pattern over said first printed pattern, said second printed pattern having a color substantially different from the color of said substrate and being made up of a plurality of spaced apart wavy parallel lines, or a plurality of spaced apart wavy parallel lines of dots, or both, said lines of said second printed pattern being either parallel to or slanted with respect to the wavy spaced apart lines of said first portion of said first printed pattern.

It is an object of the present invention to provide an anti-counterfeit printed matter, in which bills, bank notes, security papers, credit cards, passports, etc. (for which publicity and reliability are required) are provided with anti-counterfeit and anti-falsification means.

Another object of the present invention is to provide an anti-counterfeit and anti-falsification means.

Another object of the present invention is to provide an anti-counterfeit printed matter, which is difficult to be counterfeited and falsified by a color copying machine or a photomechanical process.

A further object of the present invention is to provide an anti-counterfeit printed matter which makes it possible for anybody to easily distinguish between the false from the truth.

A still further object of the present invention is to provide a method for printing such products as bills, bank notes, security papers, credit cards, passports, and other valuable printed matters which are required to have means for preventing counterfeiting and falsification.

These objects can be achieved by the above-mentioned constitution of a printed matter and a method for printing the same according to the present invention. Specific embodiments of the invention are exemplified in the accompanying drawings and the detailed description to follow. It is to be understood that minor rectifications and modifications of these embodiments are also included in the scope of the appended claims.

BRIEF DESCRIPTION OF THE DRAWINGS

FIG. 1(*b*) is a view showing straight lines;

FIG. 1(*c*) is a view showing a three-dimensional image pattern;

FIG. 1(*d*) is a view showing a background pattern;

FIG. 3(*b*) is partly enlarged view of a part $\alpha$ of FIG. 3(*a*);

FIG. 5(*b*) is a partly enlarged view of FIG. 5(*a*);

DETAILED DESCRIPTION OF THE EMBODIMENTS

Figure 4:
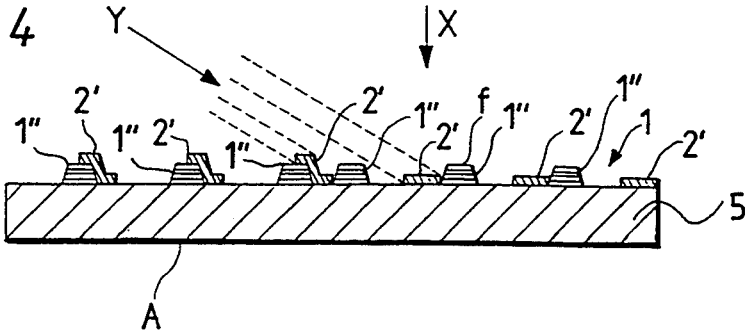
FIG. 4 is am explanatory view of an enlarged cross-section taken on line IV—IV of FIG. 3(*a*)

A first embodiment of the present invention will now be described in detail with reference to the accompanying drawings. FIG. 1(*a*) is a straight image lines (1'), in which a straight lines pattern (1) [100 straight lines per inch, and the line area is 50%] expressing, as one of patterns, a figure (f)—T-shaped figure in the example of FIG. 1(*a*)—formed at a central portion by partly drawing straight image lines (1') at different angles. This straight lines pattern (1) is printed on a white paper (5) (see FIG. 4) in opaque white intaglio ink using an intaglio plate made from film expressing the straight lines pattern (1) by etching or the like. The straight image lines (1') of the straight pattern is printed to form straight image printed lines (1''). Straights lines (2)—in FIG. 1(*b*), 100 straight lines per inch, and the line area is 10 to 80%—arranged at predetermined spaces are offset-printed on the straight image printed lines (1'') in parallel relation to the straight image printed lines (1'') in colored ink, other than opaque white ink or colorless transparent ink, to obtain a latent image printed matter (A) having a latent image. In FIG. 4, reference numeral (2') denotes straight printed lines obtained by planographic printing of the straight lines (2).

Figure 1A:
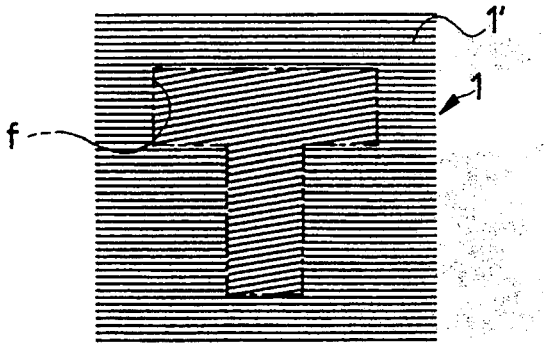
FIG. 1(*a*) is a view showing straight image lines forming a straight lines pattern by drawing straight image lines partly at different angles.
Figure 1B:
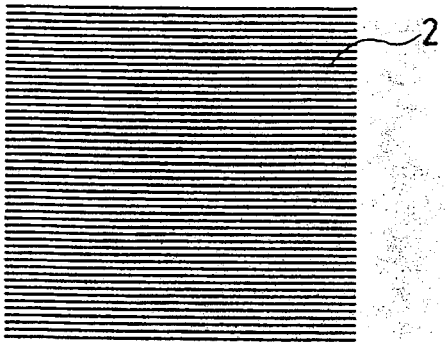
Figure 1C:
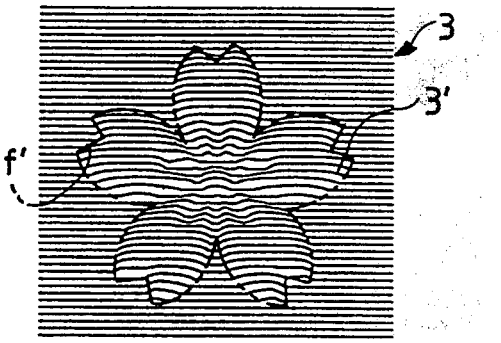
Figure 1D:
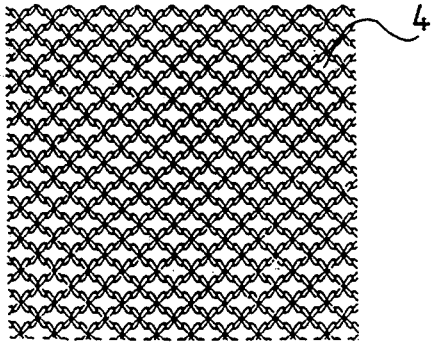
Figure 2:
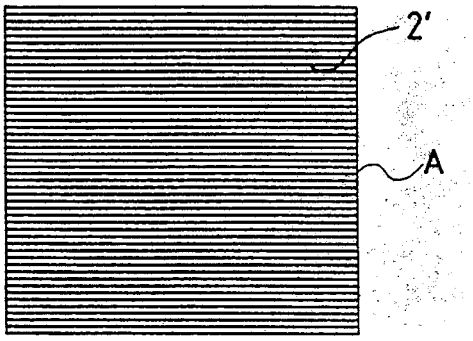
FIG. 2 is a view of a printed matter according to a first embodiment of the present invention, when viewed in a direction perpendicular to a paper surface.
Figure 3A:
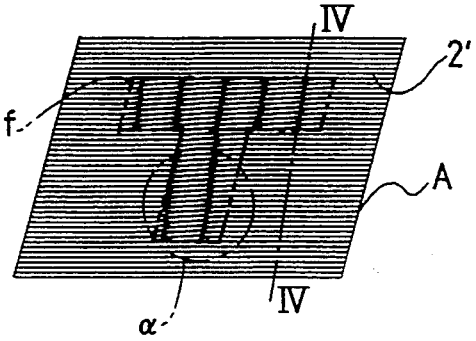
FIG. 3(*a*) is a schematic view of the printed matter of FIG. 2, when viewed in a direction at a right angle to the straight lines and slanted with respect to the paper surface.
Figure 3B:
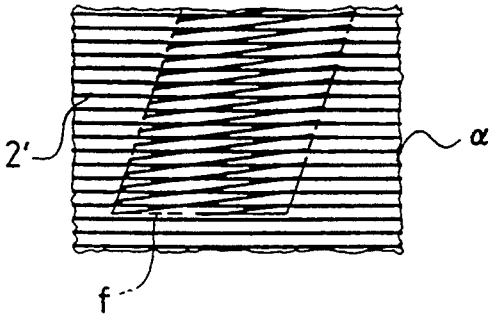

FIG. 2 shows a view of this latent image printed matter (A) when viewed in a direction perpendicular to the paper surface. FIG. 3(*a*) is a view of the latent image printed matter (A) when viewed in a direction at a right angle to the straight printed lines (2') and slanted with respect to the paper surface. FIG. 3(*b*) is an enlarged view of a portion $\alpha$ of FIG. 3(*a*). When the latent image printed matter (A) is viewed in a perpendicular direction to the paper surface (X-direction of FIG. 4) as in FIG. 2, it is only the colored straight printed lines (2') that can be visually recognized and the figure (f) cannot be visually recognized because the color of the straight image printed lines (1'') is same as that of the white paper (5). When the latent image printed matter (A) is viewed in a direction at a right angle to the straight printed lines (2') and inclined with respect to the paper surface (Y-direction of FIG. 4), the figure (f) can be very easily visually recognized because the colored straight offset printed lines (2') are partly hidden by the straight image raised printed lines (1''). When the latent image printed matter (A) is viewed in a direction at a right angle to the straight offset printed lines (2') and reversely slanted with respect to the paper surface of FIG. 3(*a*), the figure (f) can be likewise visually recognized, but light and shade are reversed.

FIG. 4 is an enlarged sectional view of the latent image printed matter (A) taken on lines IV—IV of FIG. 3(*a*), in which there are straight image printed lines (1'')—intaglio printed lines in FIG. 4—raised on the white paper (5), and straight printed lines (2') printed, at predetermined spaces, on the straight image printed lines (1'') expressing figure (f).

Although the straight printed lines (2') are printed at regular spaces, the straight image raised printed lines (1'') are changed in position relative to the straight printed lines (2') because the angle is changed at the figure (f) portion as shown in FIG. 1(*a*). For this reason, the straight printed lines (2') are partly printed on the straight raised image printed lines (1'') and partly on other the surface of the substrate. When this latent image printed matter (A) is viewed in an X-direction, the straight printed lines (2') are seen as having an equal width. However, when the latent image printed matter (A) is viewed in a Y-direction, the straight image printed lines (1'') are partly hidden by the raised straight image printed lines (1''). Since density of different colors is visually recognized depending on position, the figure (f) of the latent image appears. Even if an intaglio ink having a slightly transparent property is used for drawing the straight image raises printed lines (1''), the figure (f) can be easily visually recognized. Even if the line number and line area of the straight printed lines (2') are made fine or rough, and even if the straight printed lines (2') are changed to half-tone dots, there can be obtained a latent image printed matter (A) in which the figure (f) can be easily visually recognized.

Instead of the intaglio printing, ink may be printed in raised condition by a screen printing with the same functions and effects. The substrate to be printed is not limited to the afore-mentioned paper but it may be a metal material or a synthetic resin material. Even if the printing is made on metal material or synthetic resin material, there can be obtained a printed matter having the same functions and effects as with a paper substrate.

Instead of the straight image lines (1'), the above figure (f) may be expressed by wavy image lines, or by combination of straight and wavy image lines. In the case where wavy image lines are used for the raised printing, wavy lines are also used for the second printed pattern.

As a second embodiment of the present invention, relief (i.e., three-dimensional image) pattern printed lines (3'') are printed on the white paper (5) in intaglio ink of an opaque white color using an intaglio plate made, by etching, from a film expressing the three-dimensional image pattern (3). The three-dimensional pattern is obtained by partly changing the space between adjacent the relief image lines (3'). The straight line portions of the pattern has 100 lines per inch, and the line area is 50%. The image represents a cherry blossom-like figure (f') of FIG. 1(*c*). The straight printed lines (2') are offset-printed, at predetermined spaces, on the relief pattern printed lines (3'') in colored ink other than the above-mentioned white [colorless] or transparent colors in parallel relation (or in slant relation) to the relief pattern printed lines (3''). In this way, a latent image printed matter (B) of FIG. 5(*a*) is made.

Figure 5A:
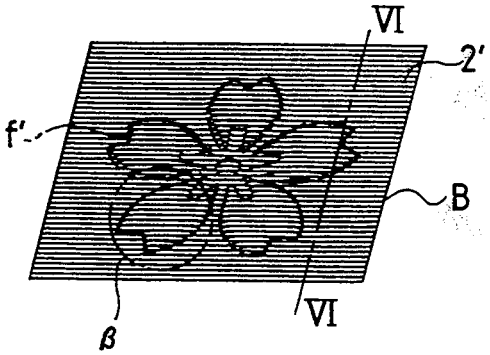
FIG. 5(*a*) is a schematic view of a printed matter according to a second embodiment of the present invention, when viewed in a direction viewed at a right angle to the straight lines and slanted with respect to the paper surface.
Figure 5B:
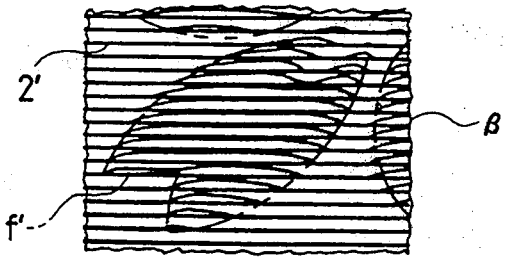

When this latent image printed matter (B) is viewed in a perpendicular direction to the paper surface, it is only the colored straight printed lines (2') that can be visually recognized and the cherry blossom-like figure (f') cannot be visually recognized because the color of the relief pattern printed lines (3'') is same as that of the white paper (5). FIG. 5(*a*) is a view showing the latent image printed matter (B) when viewed in a direction at a right angle to the straight printed lines (2') and slanted with respect to the paper surface. FIG. 5(*b*) is an enlarged view of a portion S of FIG. 5(*a*). When the latent image printed matter (B) is viewed in a perpendicular direction to the paper surface, it is only the colored straight printed lines (2') that can be visually recognized and the relief pattern (3) cannot be visually recognized. When the latent image printed matter (B) is viewed at a right angle to the straight printed lines (2') and at a slant to the paper surface as in FIG. 5(*a*), the cherry blossom-like figure (f') of the relief pattern (3) can be very easily visually recognized. When the latent image printed matter (B) is viewed in a perpendicular direction to the straight printed lines (2') and slanted in the opposite direction to the paper surface of FIG. 5(*a*), the cherry blossom-like figure (f') can likewise be visually recognized, but the light and dark portions of the relief pattern (3) are reversed.

Figure 6:
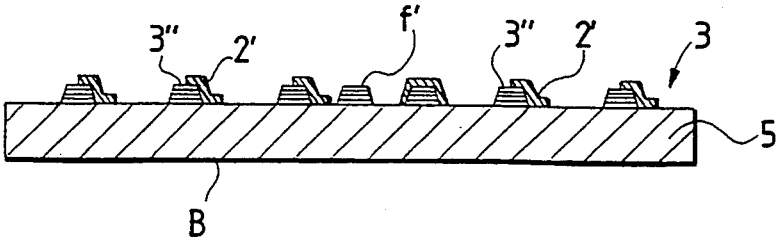
FIG. 6 is an explanatory view showing an enlarged cross-section taken on line VI—VI of FIG. 5(*a*)

FIG. 6 is an explanatory view of an enlarged section taken on line XI—XI of the latent image printed matter (B) of FIG. 5(*a*). In FIG. 6, the relief pattern printed lines (3'') intaglio printed lines in the illustrated example—are printed at irregular spaces on the white paper (5) in raised condition, and the straight printed lines (2') are printed at predetermined spaces on these relief pattern printed lines (3''). The principle why the cherry blossom-like figure (f') is a latent image is the same as that of the first embodiment.

Even if an intaglio ink having a slightly transparent property is used for drawing the relief pattern printed lines (3''), the figure (f') can be easily visually recognized. Even if the straight printed lines (2') are changed to printed half-tone dots, there can be obtained a latent image printed matter in which the figure (f') can be easily visually recognized.

As a third embodiment of the present invention, a background pattern (4) [FIG. 1(*d*)] is printed on the white paper (5) in colored ink other than white or colorless transparent colors. The three-dimensional relief pattern printed lines (3'') are printed on the printed background pattern (4') in intaglio ink of an opaque white color using an intaglio plate made, by etching, from a film expressing the relief pattern (3). The straight printed lines (2') are offset-printed, at predetermined spaces, on the printed background pattern (4') and on the relief pattern printed lines (3'') in colored ink other than the color of the printed background pattern (4') and of the relief pattern printed lines (3''), in parallel relation (or in slant relation) to the relief pattern printed lines (3''). In this way, a three-dimensional latent image printed matter (C) is made (see FIG. 9).

Figure 7:
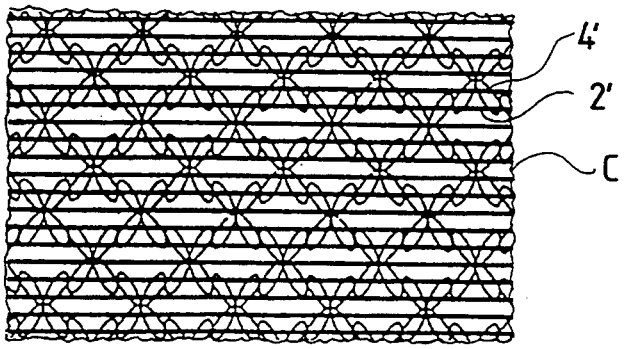
FIG. 7 is a view of a printed matter according to a third embodiment of the present invention, when viewed in a direction perpendicular to the paper surface.
Figure 8:
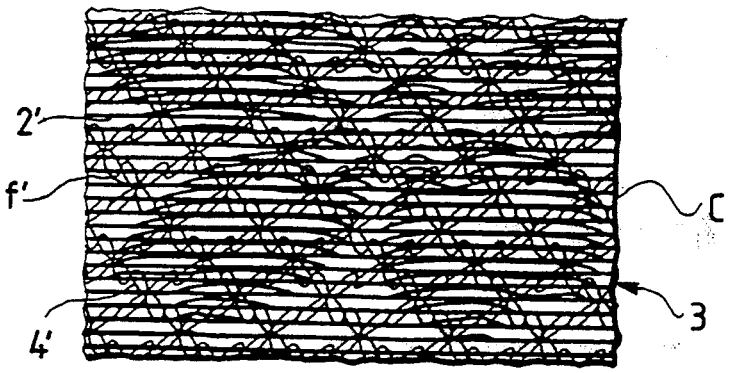
FIG. 8 is a partly enlarged view of the printed matter of FIG. 7, when viewed in a direction at a right angle to the straight lines and slanted with respect to the paper surface.
Figure 9:
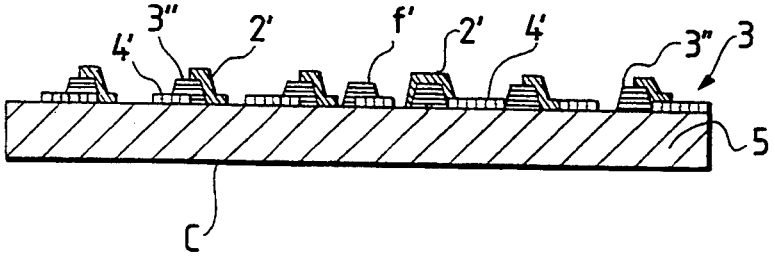
FIG. 9 is an explanatory view showing a partly enlarged cross-section of FIG. 7.

FIG. 7 is a view of the latent image printed matter (C) when viewed in a perpendicular direction to the paper surface. FIG. 8 is a view of the latent image printed matter (C) when viewed in a direction at a right angle to the straight printed lines (2') and slanted with respect to the paper surface. When this latent image printed matter (C) is viewed in the perpendicular direction to the paper surface as shown in FIG. 7, it is only the colored straight printed lines (2') and printed background pattern (4') that can be visually recognized and the figure (f') cannot be visually recognized because the color of the relief pattern printed lines (3'') is same as that of the white paper (5). When the latent image printed matter (C) is viewed in a direction at a right angle to the straight printed lines (2') and slanted with respect to the paper surface, the cherry blossom-like figure (f') can be very easily visually recognized as shown in FIG. 8. When the latent image printed matter (C) is viewed in a direction at a right angle to the straight printed lines (2') and slanted in the opposite direction with respect to the paper surface of FIG. 8, the figure (f') can be likewise visually recognized but light and dark portions are reversed. Even if an intaglio ink having a slightly transparent property is used for drawing the relief pattern of printed lines (3''), the figure (f') can be easily visually recognized. Even if the straight printed lines (2') are changed to printed half-tone dots, the figure (f') can be easily visually recognized. When the latent image printed matter (C) is viewed in the perpendicular direction to the paper surface as mentioned above, it is more difficult, relative, e.g., to the embodiments of FIGS. 4 and 6, to visually recognize the cherry blossom-like figure (f') of the latent image because of the provision of the printed background pattern (4'). The latent image printed matter (C) provided with such background printing as well as latent image printed matters (D) and (D') as later described can be printed matters exhibiting effects of beauty. When the latent image printed matter (C) is viewed in a perpendicular direction to the paper surface, it is difficult to visually recognize the cherry blossom-like figure (f') of the latent image because of the provision of the background printing, and therefore, the latent image printed matter (C) can exhibit an effect of beauty. FIG. 9 is an explanatory view of an enlarged section of the same portion as the second embodiment—portion taken on line VI—VI of FIG. 5(*a*)—of the latent image printed matter (C). In FIG. 9, the printed background pattern (4') is drawn on the white paper (5), and the relief pattern printed lines (3'')—intaglio printed lines in the illustrated example—are printed at irregular spaces on the printed lines (2') are printed at predetermined spaces on the printed background pattern (4'), and the straight printed lines (2') are printed at predetermined spaces on the printed background pattern (4') and relief pattern printed lines (3''). The principle why the cherry blossom-like figure (f') appears here as a latent image is the same as that of the first embodiment.

Furthermore, as a fourth embodiment, a three-dimensional relief pattern (3) is printed on the white paper (5) in intaglio ink of a white color using an intaglio plate made, by etching, from a film expressing relief pattern (3). (See FIG. 10). The background pattern (4) is printed on the relief pattern printed lines (3'') in colored ink other than white color. The straight printed lines (2') are offset-printed, at predetermined spaces, on the relief pattern printed lines (3'') and the printed background pattern (4'), in colored ink other than those of the relief pattern printed lines (3'') and of the printed background pattern (4'), in parallel relation (or in slant relation) to the relief pattern printed lines (3''). In this way, a latent image printed matter (D) is made.

When the latent image printed matter (D) is viewed in a perpendicular direction to the paper surface, it is only the colored straight printed lines (2') and printed background pattern (4') that can be visually recognized and the figure (f') cannot be visually recognized because the color of the relief pattern printed lines (3'') is same as that of the white paper (5). When the latent image printed matter (D) is viewed in a direction at a right angle to the straight printed lines (2') and slanted with respect to the paper surface, the figure (f') can be very easily visually recognized. When the latent image printed matter (D) is viewed in a direction reversely slanted with respect to the paper surface, the figure (f') can be likewise visually recognized with light and dark portions reversed. Even if an intaglio ink having a slightly transparent property is used for drawing the relief pattern printed lines (3''), the figure (f') can be easily visually recognized. Even if the straight printed lines (2') are changed to half-tone dots, the figure (f') can be easily visually recognized.

Furthermore, even if the printed background pattern (4') and the straight printed lines (2') are printed in a reverse order, there can be obtained a latent image printed matter (D') (not shown) which exhibits the same functions and effects.

Figure 10:
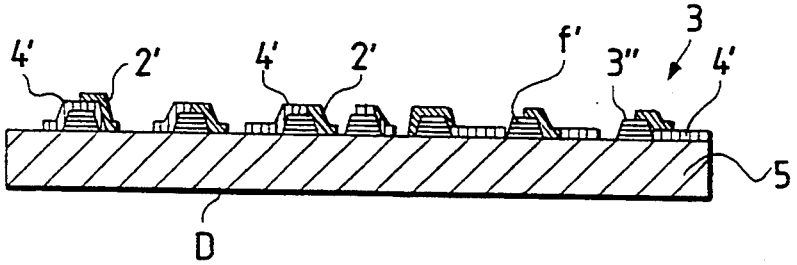
FIG. 10 is in explanatory view showing a partly enlarged cross-section of a printed matter according to a fourth embodiment of the present invention.

FIG. 10 is an explanatory view of an enlarged section of the same portion as the second embodiment—portion taken on line VI—VI of FIG. 5(*a*)—of the latent image printed matter (D). In FIG. 10, the raised relief pattern printed lines (3'')—intaglio printed lines in the illustrated example—are printed on the white paper (5), and the straight printed lines (2') are printed at predetermined spaces on the relief pattern printed lines (3'') and the printed background pattern (4').

The white paper (5) described in the respective embodiments may be, for example, a yellow paper. In that case, the ink used for the straight image printed lines (1'') and the relief pattern printed lines (3'') has the same yellow color as the paper.

When the present invention is applied to printing matters for which publicity and reliability are required, such as bills, bank notes, security papers, passports, credit cards and the like, it can be easily judged whether or not the bills, etc. are counterfeit notes because letters and figures can be very easily visually recognized only when they are observed in an adequate direction. Therefore, the bills, etc. incorporated with the present invention are very difficult to be counterfeited and/or falsified.

Any attempt to copy the printed matter of the present invention using a color copying machine or a photomechanical process will fail because it is practically impossible to extract the printed lines in their raised condition, and it is only the flat printed lines that can be reproduced. Since complicated moiré pattern appears on the duplicated copy, the letters, figures, etc. cannot be visually recognized.

According to the present invention, there can be obtained a high quality latent image printed matter by printing the straight image printed lines, the wavy image printed lines, the relief image printed lines, the straight printed lines, the background image printed lines, etc. one upon another in raised condition by a printing machine. Such obtained printed matter includes a precise complicated latent image. It is a feature of the present invention that the printed matter of the present invention can be applied to a product having a comparatively small printing area. This means that the present invention is very effective when applied to bills, bank notes, security papers, passports, various kinds of credit cards, etc.

What is claimed is:

1. A latent image printed matter comprising:

a first printed pattern printed by raised printing on a substrate, said raised printed pattern having a first portion which comprises a plurality of straight parallel spaced apart lines and having a second portion which comprises a plurality of spaced apart wavy lines, or a plurality of straight parallel spaced apart lines slanted with respect to the straight lines of said first portion, or both, said raised printed pattern having a color substantially the same as the color of said substrate; and a second printed pattern printed over said first printed pattern, said second printed pattern having a color substantially different from the color of said substrate and being made up of a plurality of spaced apart straight parallel lines, or a plurality of spaced apart straight parallel lines of dots, or both, said lines of said second printed pattern being either parallel to or slanted with respect to the straight spaced apart parallel lines of said first portion of said first printed pattern.

2. A latent image printed matter according to claim 1 wherein said first printed pattern comprises a three-dimensional image.

3. A latent image printed matter according to claim 1 further comprising a background pattern printed in an ink having a color which contrasts with that of the substrate.

4. A latent image printed matter according to claim 3 wherein said background pattern is printed underneath said first pattern.

5. A latent image printed matter according to claim 3 wherein said background pattern is printed between said first and second patterns.

6. A latent image printed matter according to claim 3 wherein said background pattern is printed over said second pattern.

7. A method of producing a latent image printed matter comprising:

printing by raised printing, a first printed pattern on a substrate, said raised printed pattern having a first portion which comprises a plurality of straight parallel spaced apart lines and having a second portion which comprises a plurality of spaced apart wavy lines, or a plurality of straight parallel spaced apart lines slanted with respect to the straight lines of said first portion, or both, said raised printed pattern having a color substantially the same as the color of said substrate; and printing a second printed pattern over said first printed pattern, said second printed pattern having a color substantially different from the color of said substrate and being made up of a plurality of spaced apart straight parallel lines, or a plurality of spaced apart straight parallel lines of dots, or both, said lines of said second printed pattern being either parallel to or slanted with respect to the straight spaced apart parallel lines of said first portion of said first printed pattern.

8. A method according to claim 7 wherein said first printed pattern comprises a three-dimensional image.

9. A method according to claim 7 further comprising printing on the substrate a background pattern printed in an ink having a color which contrasts with that of the substrate.

10. A method according to claim 9 wherein said background pattern is printed underneath said first pattern.

11. A method according to claim 9 wherein said background pattern is printed between said first and second patterns.

12. A method according to claim 9 wherein said background pattern is printed over said second pattern.

13. A latent image printed matter comprising:

a first printed pattern printed by raised printing on a substrate, said raised printed pattern having a first portion which comprises a plurality of wavy spaced apart parallel lines and having a second portion which comprises a plurality of spaced apart straight parallel lines, or a plurality of spaced apart wavy parallel lines slanted with respect to the wavy lines of said first portion, or both, said raised printed pattern having a color substantially the same as the color of said substrate; and a second printed pattern printed over said first printed pattern, said second printed pattern having a color substantially different from the color of said substrate and being made up of a plurality of spaced apart wavy parallel lines, or a plurality of spaced apart wavy parallel lines of dots, or both, said lines of said second printed pattern being either parallel to or slanted with respect to the wavy spaced apart lines of said first portion of said first printed pattern.

14. A latent image printed matter according to claim 13 wherein said first printed pattern comprises a three-dimensional image.

15. A latent image printed matter according to claim 13 further comprising a background pattern printed in an ink having a color which contrasts with that of the substrate.

16. A latent image printed matter according to claim 15 wherein said background pattern is printed underneath said first pattern.

17. A latent image printed matter according to claim 15 wherein said background pattern is printed between said first and second patterns.

18. A latent image printed matter according to claim 15 wherein said background pattern is printed over said second pattern.

19. A method of producing a latent image printed matter comprising:

printing, by raised printing, a first printed pattern on a substrate, said raised printed pattern having a first portion which comprises a plurality of spaced apart wavy parallel lines and having a second portion which comprises a plurality of spaced apart straight parallel lines, or a plurality of wavy spaced apart parallel lines slanted with respect to the wavy lines of said first portion, or both, said raised printed pattern having a color substantially the same as the color of said substrate; and printing a second printed pattern over said first printed pattern, said second printed pattern having a color substantially different from the color of said substrate and being made up of a plurality of spaced apart wavy parallel lines, or a plurality of spaced apart wavy parallel lines of dots, or both, said lines of said second printed pattern being either parallel to or slanted with respect to the wavy spaced apart lines of said first portion of said first printed pattern.

20. A method according to claim 19 wherein said first printed pattern comprises a three-dimensional image.

21. A method according to claim 19 further comprising printing on the substrate a background pattern printed in an ink having a color which contrasts with that of the substrate.

22. A method according to claim 21 wherein said background pattern is printed underneath said first pattern.

23. A method according to claim 21 wherein said background pattern is printed between said first and second patterns.

24. A method according to claim 21 wherein said background pattern is printed over said second pattern.

* * * * *